US010029187B2

(12) United States Patent
Liu et al.

(10) Patent No.: US 10,029,187 B2
(45) Date of Patent: Jul. 24, 2018

(54) TOY ASSEMBLING APPARATUS

(71) Applicant: UBTECH ROBOTICS CORP., Shenzhen, Guangdong Province (CN)

(72) Inventors: Lefeng Liu, Shenzhen (CN); Yumiao Wu, Shenzhen (CN); Dingkai Xing, Shenzhen (CN); Xiongyuan Fang, Shenzhen (CN); Xinpu Chen, Shenzhen (CN)

(73) Assignee: UBTECH ROBOTICS CORP., Shenzhen, Guangdong Province (CN)

( * ) Notice: Subject to any disclaimer, the term of this patent is extended or adjusted under 35 U.S.C. 154(b) by 0 days.

(21) Appl. No.: 15/390,532

(22) Filed: Dec. 25, 2016

(65) Prior Publication Data

US 2017/0274295 A1 Sep. 28, 2017

(30) Foreign Application Priority Data

Mar. 24, 2016 (CN) ..... 2016 1 0171138
Mar. 24, 2016 (CN) ..... 2016 1 0172735
(Continued)

(51) Int. Cl.
*A63H 33/08* (2006.01)

(52) U.S. Cl.
CPC ..... *A63H 33/08* (2013.01); *A63H 33/084* (2013.01); *A63H 33/086* (2013.01)

(58) Field of Classification Search
CPC .... A63H 33/08; A63H 33/082; A63H 33/084; A63H 33/086; A63H 33/04; A63H 33/105
(Continued)

(56) References Cited

U.S. PATENT DOCUMENTS 1,084,597 A * 1/1914 Anft ..... A63H 33/082 446/127
2,907,137 A * 10/1959 Ehrmann ..... A63H 33/082 446/127
(Continued)

FOREIGN PATENT DOCUMENTS

CN 104722086 6/2015
JP 55-157252 2/1983
(Continued)

*Primary Examiner* — Alexander Niconovich
(74) *Attorney, Agent, or Firm* — Cheng-Ju Chiang

(57) ABSTRACT

A toy assembling apparatus is disclosed. The toy assembling apparatus includes at least one connector, and each connector having at least one of a first connecting portion and a second connecting portion. The first connecting portion includes a connection plate and a connection pillar disposed on the connection plate. The second connecting portion includes a left side board, a right side board, a back side board, a bottom board, and a top board, which jointly form a containing slot for inserting the first connecting portion. The containing slot includes a plate slot for containing the connection plate and a pillar slot for containing the connection pillar. Limit grooves or limit protrudes are formed on the connection pillar. The pillar slot has protrudes or grooves formed thereon correspondingly. The limit grooves match the limit protrudes, such that the first connecting portion matches the second connecting portion of another connector tightly.

25 Claims, 18 Drawing Sheets

(30) Foreign Application Priority Data

| | | |
|---|---|---|
| Mar. 24, 2016 | (CN) | 2016 1 0173370 |
| Mar. 24, 2016 | (CN) | 2016 1 0173646 |
| Mar. 24, 2016 | (CN) | 2016 1 0173648 |
| Mar. 24, 2016 | (CN) | 2016 1 0173650 |
| Mar. 24, 2016 | (CN) | 2016 1 0176046 |
| Mar. 24, 2016 | (CN) | 2016 1 0176206 |
| Mar. 24, 2016 | (CN) | 2016 1 0176461 |
| Mar. 24, 2016 | (CN) | 2016 1 0176569 |
| Mar. 24, 2016 | (CN) | 2016 1 0176727 |
| Mar. 24, 2016 | (CN) | 2016 1 0176847 |
| Mar. 24, 2016 | (CN) | 2016 1 0177106 |

(58) Field of Classification Search
USPC ..... 446/85, 124, 125, 127
See application file for complete search history.

(56) References Cited

U.S. PATENT DOCUMENTS

| | | | | | |
|---|---|---|---|---|---|
| 3,513,588 | A * | 5/1970 | Fischer | A63H 33/082 | 446/127 |
| 3,591,973 | A * | 7/1971 | Fischer | A63H 33/082 | 446/127 |
| 3,811,219 | A * | 5/1974 | Fischer | A63H 33/067 | 446/107 |
| 4,035,947 | A * | 7/1977 | Burge | A63H 33/082 | 446/127 |
| 4,050,184 | A * | 9/1977 | Chiari | A63H 33/101 | 273/157 R |
| 4,345,762 | A * | 8/1982 | Lebelson | A63H 33/065 | 273/157 R |
| 4,484,407 | A * | 11/1984 | Petersson | A63H 33/102 | 403/292 |
| 4,764,143 | A * | 8/1988 | Gat | A63H 33/105 | 446/102 |
| 4,822,315 | A * | 4/1989 | Ben-Gal | A63H 33/042 | 446/102 |
| 5,951,356 | A * | 9/1999 | Cyrus | A63H 18/00 | 446/110 |
| 6,050,044 | A * | 4/2000 | McIntosh | A63H 33/082 | 446/124 |
| 6,059,631 | A * | 5/2000 | Maddock | A63H 33/082 | 446/104 |
| 6,142,847 | A * | 11/2000 | Rudy | A63H 19/30 | 446/122 |
| 6,241,248 | B1 * | 6/2001 | Winter | A63F 9/12 | 273/153 S |
| 6,250,986 | B1 * | 6/2001 | Sorensen | A63H 33/062 | 446/121 |
| 6,325,694 | B1 * | 12/2001 | Clever | A63H 33/082 | 403/165 |
| 7,198,270 | B1 * | 4/2007 | Bishop | A63F 9/12 | 273/153 S |
| 7,988,517 | B2 * | 8/2011 | Bishop | A63H 33/082 | 446/108 |
| 9,238,179 | B2 * | 1/2016 | Carpenter | A63H 33/062 | |
| 9,480,932 | B2 * | 11/2016 | Weiss | B65D 21/0204 | |
| 2004/0121699 | A1 * | 6/2004 | Ladner | A63H 33/082 | 446/85 |
| 2005/0106989 | A1 * | 5/2005 | Rincover | A63H 33/082 | 446/85 |
| 2013/0165012 | A1 * | 6/2013 | Klauber | A63H 33/062 | 446/91 |
| 2014/0106108 | A1 * | 4/2014 | Lin | A63H 33/082 | 428/58 |
| 2014/0335753 | A1 | 11/2014 | Weiss | | |

FOREIGN PATENT DOCUMENTS

| | | |
|---|---|---|
| JP | 60-13166 | 8/1986 |
| JP | 4-70266 | 4/1994 |
| JP | 2003-190662 | 7/2003 |
| JP | 3178676 | 9/2012 |
| JP | 3194740 | 12/2014 |
| JP | 2016-87416 | 5/2016 |
| WO | WO2006/059527 | 6/2006 |

* cited by examiner

TOY ASSEMBLING APPARATUS

CROSS REFERENCE TO RELATED APPLICATIONS

This application claims priority to Chinese Patent Application Nos. 201610173370.4, 201610176206.9, 201610176461.3, 201610176727.4, 201610177106.8, 201610176569.2, 201610172735.1, 201610173648.8, 201610173646.9, 201610176847.4, 201610173650.5, 201610176046.8, and 201610171138.7, all filed on Mar. 24, 2016, which are hereby incorporated by reference herein as if set forth in its entirety.

TECHNICAL FIELD

The present disclosure generally relates to toy building blocks, and more particular relates to a toy building block assembling apparatus.

BACKGROUND

Currently, toy building blocks are widely fond as an education type toy which is used to stimulate children's imagination and creativity. In the conventional toy building blocks, the connection between two toy building blocks is mainly implemented through engaging a cylinder protruding from one building block with a containing slot of another building block. Since the engagement is not sufficiently tight, the building blocks tend to fall from the connection therebetween, and it greatly affects users' experiences and enjoyments. In another conventional art, special screw bolt modules may be used to connect two building blocks, thereby guaranteeing the tightness of the connection between the building blocks. However, since the connection method using special screw bolt modules will increase the complexity of building block assembling process, the difficulty in assembling building blocks is increased, and special tools are needed in the assembling/disassembling process, thus users' experiences and enjoyments are affected.

SUMMARY

Embodiments of the present disclosure provide a toy assembling apparatus, which guarantees tight connection between the building blocks.

One embodiment of the present disclosure is: providing a toy assembling apparatus comprising at least one connector, and each connector comprising at least one of a first connecting portion and a second connecting portion. The first connecting portion comprises a connection plate and a connection pillar disposed on the connection plate. The second connecting portion comprises a left side board, a right side board, a back side board, a bottom board, and a top board. The left side board, the right side board, the back side board, the bottom board, and the top board jointly form a containing slot for inserting the first connecting portion therein. The containing slot comprises a plate slot for containing the connection plate and a pillar slot for containing the connection pillar, wherein one or more limit grooves or one or more limit protrudes are formed thereon. The pillar slot has one or more protrudes or one or more limit grooves formed thereon correspondingly and the one or more limit grooves match the one or more limit protrudes respectively.

Another embodiment of the present disclosure is: providing a toy assembling apparatus comprising a connector. The connector comprises a connection plate and a connection pillar disposed on the connection plate. Limit grooves are formed on the connection pillar. The limit groove extends in a direction parallel to an axial direction of the connection pillar.

Still another embodiment of the present disclosure is: providing a toy assembling apparatus comprising a connector formed in a hexahedron shape. The connector comprises a left side board, a right side board, a back side board, a bottom board, and a top board. An opening is formed above the bottom board and opposite to the back side board. A plate slot communicating the opening is formed between the bottom board and the top board. A pillar slot communicating the plate slot is formed on the top board. The pillar slot is formed by three inner sides of the top board. Limit protrudes are formed on two opposite inner sides of the top board.

Advantages of the present disclosure may follow. In comparison with the current implementations, since limit grooves or limit protrudes are formed on the connection pillar of the first connector, and limit protrudes or limit grooves are correspondingly formed on the pillar slot, while the limit grooves and the limit protrudes match with each other, the first connecting portion and the second connecting portion of the present disclosure could match tightly. As a result, the tightness of connecting two connectors can be guaranteed, the failure of the connection between connectors emerges when assembling a toy can be avoided, and the convenience in assembling two connectors is improved.

DETAILED DESCRIPTION

For a thorough understanding of the present disclosure, numerous specific details are set forth in the following description for purposes of illustration but not of limitation, such as particularities of system structures, interfaces, techniques, et cetera. However, it should be appreciated by those of skill in the art that, in absence of these specific details, the present disclosure may also be carried out through other implementations. In other instances, a detailed description of well-known devices, circuits, and methods is omitted, so as to avoid unnecessary details from hindering the description of the disclosure.

Embodiments of the present disclosure disclose a toy assembling apparatus comprising a plurality of connectors, wherein the connectors may be the same with each other in structure, or may be different with each other in structure.

In one embodiment, the connectors are the same with each other in structure. Each connector comprises a first connecting portion and a second connecting portion, wherein a first connecting portion of each connector could be engaged with the second connecting portion of another connector, thereby implementing a tight match between two connectors in a toy assembling process, and the toy assembling process may be successfully finished. FIG. 1 to FIG. 5 illustrate the above-mentioned structure.

Figure 1:
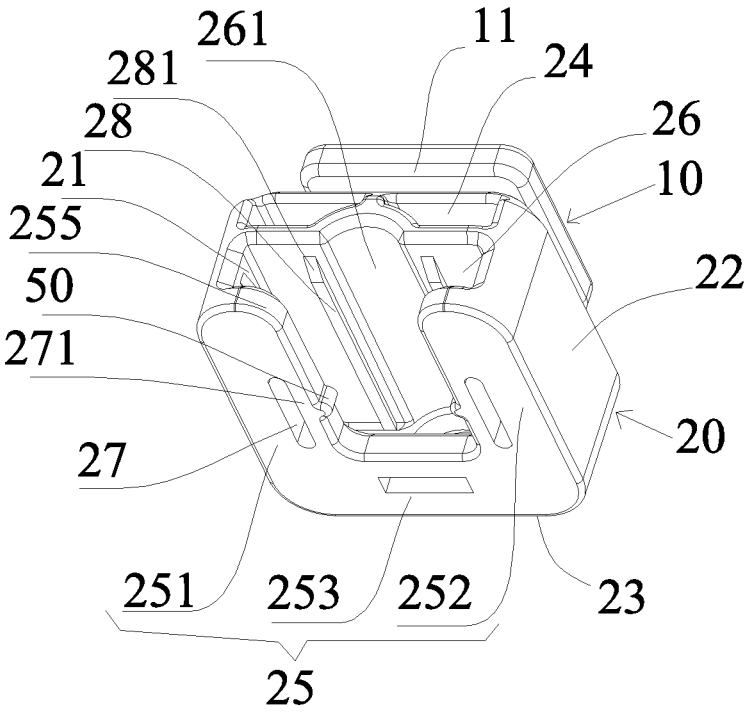
FIG. 1 is an isometric view of a connector of an embodiment according to the disclosure.

Referring to FIG. 1, an isometric view of a connector of an embodiment according to the disclosure is shown. FIG. 1 discloses one of a plurality of connectors, wherein the connector comprises a first connecting portion 10 and a second connecting portion 20. The connector is molded through injecting hard plastic.

Figure 2:
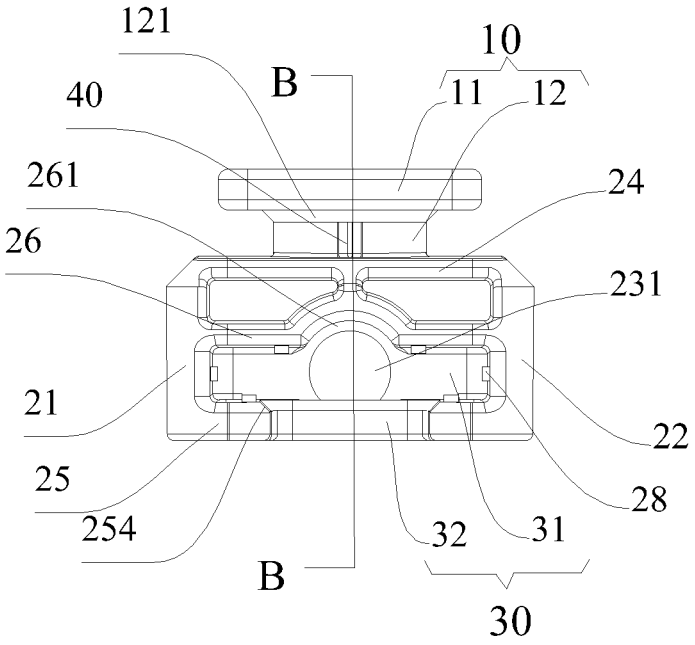
FIG. 2 is a front view of the connector shown in FIG. 1.

Referring to FIG. 2, a front view of the connector shown in FIG. 1 is shown. The first connecting portion 10 comprises a connection plate 11 and a connection pillar 12 disposed on the connection plate 11. It can be understood that the connection plate 11 may be designed in various shapes. In one embodiment, the connection plate 11 may be designed in a square shape. In comparison with a round shape, a square shape is easier to differentiate different aspects of the connection plate 11. In comparison with a rectangular shape or other shapes, the sides of a square have a same length such that a square connection plate 11 have a same structure in four aspects, and the first connecting portion 10 may be inserted into the second connecting portion 20 through any of the four aspects of the square connection plate 11.

Figure 6:
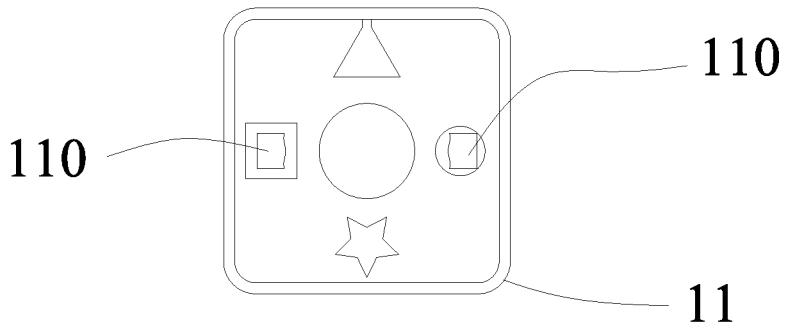
FIG. 6 is a top view of the first connecting portion of the connector shown in FIG. 1.

It can be understood that a plurality of direction symbols each correspond to an aspect of the square connection plate 11 can be disposed on the top surface of the connection plate 11, such that the aspects can be recognized through the direction symbols while a plurality of toy assembling components need to be assembled along a particular direction. Referring to FIG. 6, a top view the first connecting portion of the connector shown in FIG. 1 is shown. Four aspects of the connection plate 11 are respectively represented through the symbols Δ, □, ☆, and ○. In other embodiments, characters such as E, W, N, and S could be adopted to represent four aspects of the connection plate 11. In one embodiment, the connection plate 11 adopts the symbols Δ, □, ☆, and ○, wherein □ and ○ are opposite to each other while Δ and ☆ are opposite to each other.

The connection pillar 12 may be a cylinder or a prism. In this embodiment, the connection plate 11 and the connection pillar 12 are coaxial and disposed in a T configuration. A first chamfer 121 is formed on a junction between the connection pillar 12 and the connection plate 11.

Furthermore, limit grooves 40 are defined in the connection pillar 12. Particularly, at least one set of the limit grooves 40 are formed on opposite sides of the connection pillar 12. In one embodiment, four limit grooves 40 are uniformly distributed on the connection pillar 12. Each of the limit grooves 40 is disposed aligning with a center of each side of the square connection plate 11, and two opposite limit grooves 40 are disposed on a same diameter of the cylindrical connection pillar 12. One set of the limit grooves 40 extends to the first chamfer 121, that is, at least one part of the limit groove 40 is disposed on the first chamfer 121. Wherein, through-holes 110 are formed on the connection plate 11 and are designed in the symbols □ and ○ respectively. The through-holes 110 on the connection plate 11 communicate the opposite limit grooves 40.

Referring to both FIG. 1 and FIG. 2, the second connecting portion 20 comprises a left side board 21, a right side board 22, a back side board 23, a bottom board 24, and a top board 25. The connection pillar 12 is disposed in the bottom board 24.

Particularly, the second connecting portion 20 of the connector may be used to match the first connecting portion 10 of another connector, so as to compose, for example, a foot component of an android toy building block robot. The bottom board 24, the left side board 21, the right side board 22, the back side board 23, and the top board 25 jointly form a hexahedron, and jointly form the containing slot 30 for inserting the first connecting portion 10. It can be understood that an opening of the containing slot 30 is formed on a surface of the bottom board 24 and opposite to the back side board 23. In this embodiment, since the bottom board 24 and the top board 25 have a square shape, the inconvenience in assembling a plurality of connectors will not be caused by the differences in the lengths of different sides, hence users' experience is improved. In addition, since the edges of the four angles are designed to have a radian, the second connecting portion 20 has a smooth shape which is pleasing to the eye.

Figure 4:
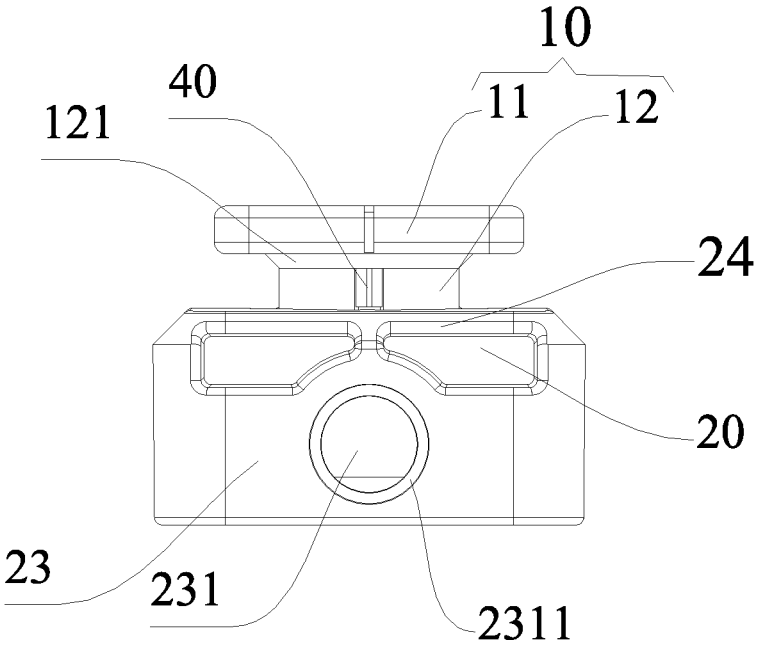
FIG. 4 is a back view of the connector shown in FIG. 1.
Figure 7:
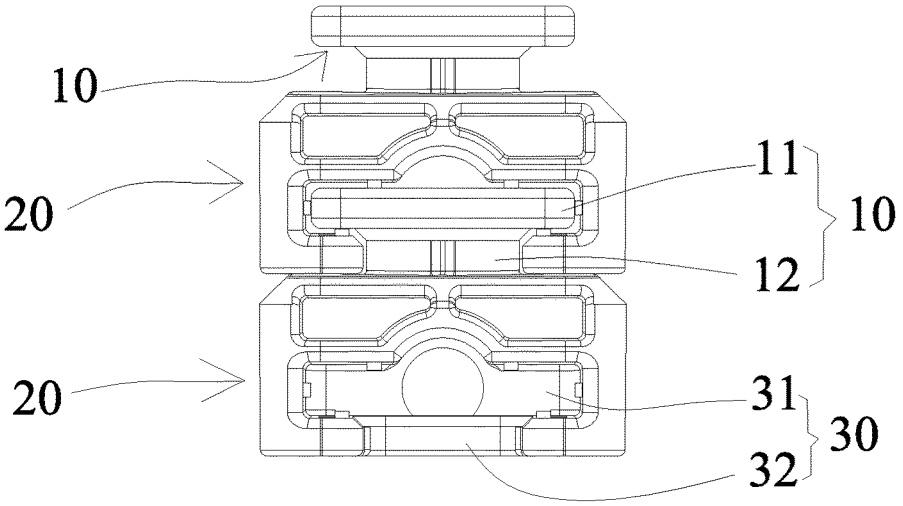
FIG. 7 is an assembled view showing two connectors of FIG. 1 engaging with each other.

Referring to FIG. 2, FIG. 4, and FIG. 7, particularly, the containing slot 30 comprises a plate slot 31 for containing the connection plate 11 and a pillar slot 32 for containing the connection pillar 12, which are in an inverted T configuration. In order to guarantee the tightness of connection, the size of plate slot 31 matches the size of the connection plate 11, while the size of the pillar slot 32 matches the size of the connection pillar 12. The pillar slot 32 is disposed in the top board 25 and communicates with the plate slot 31. Particularly, referring to FIG. 1 together, the top board 25 comprises a top board left part 251, a top board back part 253, and a top board right part 252, wherein the top board left part 251, the top board back part 253, and the top board right part 252 are integratedly molded. The inner side walls of the top board left part 251, the top board back part 253, and the top board right part 252 jointly form the pillar slot 32 for containing the connector pillar 12. In this embodiment, the distance between the top board left part 251 and the top board right part 252 is equal to the diameter of the cylindrical connection pillar 12, such that the pillar slot 32 and the connection pillar 12 could match tightly and the engagement therebetween is not easy to fail.

Figure 3:
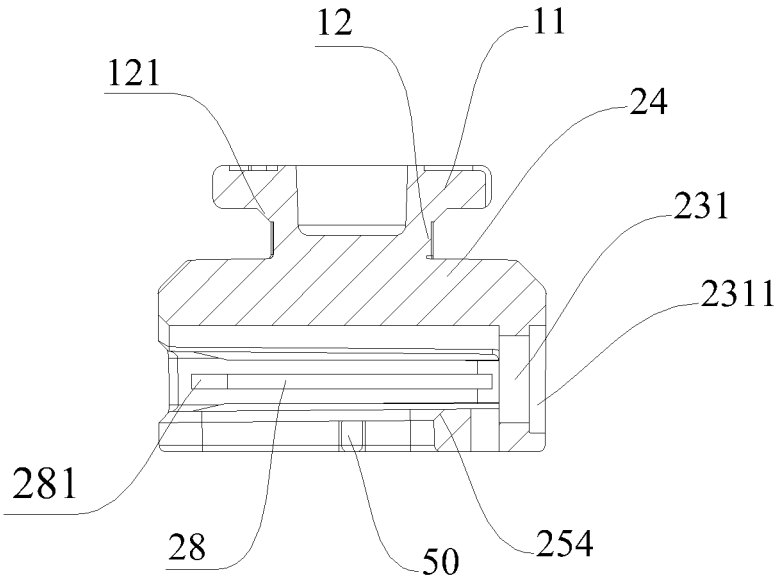
FIG. 3 is a cross-sectional view taken along a line of B-B shown in FIG. 2.

Referring to both FIG. 1 to FIG. 3, limit protrudes 50 matching the limit grooves 40 of the first connecting portion 10 are formed in the pillar slot 32 of the second connecting portion 20. Particularly, a set of the limit protrudes 50 are formed on opposite positions on inner side walls of the top board left part 251 and the top board right part 252 respectively. When the first connecting portion 10 is inserted into the containing slot 30 of the second connecting portion 20, the limit protrudes 50 on the top board left part 251 and the top board right part 252 of the second connecting portion 20 which disposed opposite to each other are inserted into the limit grooves 40 on the connection pillar 12 of the first connecting portion 10, thereby implementing a tight match between the first connecting portion 10 and the second connecting portion 20 which prevents the engagement to fail.

The distance between the limit protrude 50 and the back side board 23 is the half of the length of a side of the left side board 21, such that the limit protrude 50 locates at the central position of the second connecting portion 20 when the first connecting portion 10 is inserted into the second connecting portion 20, thereby improving its matching with other connectors.

It can be understood that, in another embodiment, limit protrudes may be formed on the connection pillar 12 of the first connecting portion 10. Correspondingly, limit grooves matching the limit protrudes may be formed on the pillar slot 32 of the second connecting portion 20. Particularly, at least one set of the limit protrudes which opposite to each other are formed on the connection pillar 12 of the first connecting portion 10, and one set of limit grooves are formed on opposite positions on the inner side walls of the top board left part 251 and the top board right part 252 of the second connecting portion 20 respectively. When the first connecting portion 10 is inserted to the containing slot 30 of the second connecting portion 20, the limit protrudes on the first connector 10 is inserted into the limit grooves on opposite positions on the top board left part 251 and the top board right part 252 of the second connecting portion 20, thereby implementing a tight match between the first connecting portion 10 and the second connecting portion 20 which prevents the engagement to fail.

Furthermore, four limit protrudes are uniformly distributed on the connection pillar 12 of the first connecting portion 10. Each of the limit protrudes is disposed aligning with the center of each side of the square connection plate 11, and two opposite limit protrudes are disposed on a same diameter of the cylindrical connection pillar 12. The distance between the limit grooves on the top board left part 251 or the top board right part 252 and the back side board 23 is the half of the length of a side of the left side board 21, such that the first connecting portion 10 locates at the central position of the second connecting portion 20 when the first connecting portion 10 is inserted into the second connecting portion 20, thereby improving its matching with other connectors.

Figure 5:
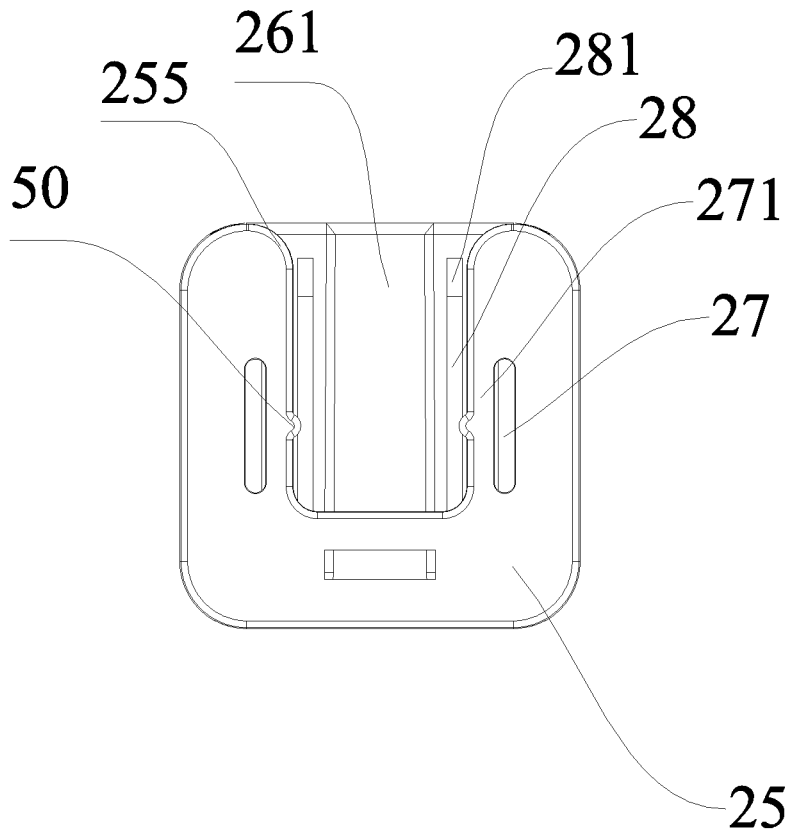
FIG. 5 is a bottom view of the connector shown in FIG. 1.

Referring to both FIG. 1 and FIG. 5, a bar slot 27 is formed in each of the top board left part 251 and the top board right part 252 respectively. The bar slot 27 is parallel to the direction for inserting the first connecting portion 10 into the containing slot 30 and aligns with the limit protrude 50/the limit groove 40 to provide deformation space, and a deformation thin wall 271 is formed between the bar slot 27 and the limit protrude 50/the limit groove 40. When the first connecting portion 10 and the second connecting portion 20 are assembled or disassembled, the deformation thin wall 271 deforms in a certain extent, such that the limit protrude 50 can be inserted into the limit groove 40 or be separated from the limit groove 40.

Referring to FIG. 2, FIG. 3, and FIG. 4, a circular connection aperture 231 may be formed in the back side board 23 of the second connecting portion 20. The circular connection aperture 231 is used to connect the connector (e.g., connection bolt) of other toy assembling apparatus, thereby increasing users' experience. Particularly, a limit emargination 2311 is formed on at least one end of the circular connection aperture 231 for engaging a limit flange on a connection bolt. When the connection bolt is inserted to the circular connection aperture 231, the limit flange of the connection bolt matches the limit emargination 2311, thereby avoiding the rough and uneven on the connection surface.

Furthermore, the second connecting portion 20 further comprises a support plate 26. The support plate 26 is disposed in the containing slot 30 and is parallel to the bottom board 24 and the top board 25. A slot 261 matching the circular connection aperture 231 is formed on the support plate 26, such that the connection bolt can be inserted into the second connecting portion 20. At the time, the inner walls of the support plate 26, the left side board 21, the right side board 22, the back side board 23, and the top board 25 jointly form the plate slot 31 for containing the connection plate 11. In order to guarantee the tightness of the matching between the first connecting portion 10 and the second connecting portion 20, a plurality of reinforcing ribs 28 can be disposed in the containing slot 30 of the second connecting portion 20. When the first connecting portion 10 is inserted into the containing slot 30, the reinforcing ribs 28 could match the connection plate 11, thereby avoiding the first connecting portion 10 to come off. Particularly, at least one reinforcing rib 28 can be disposed on each of the inner walls of the support plate 26, the top board 25, the left side board 21, and the right side board 22. In addition, the reinforcing rib 28 extends in a direction parallel to the direction for inserting the first connecting portion 10 into the containing slot 30, so as to guarantee the tightness of the connection between the connection plate 11 and the containing slot 30, thereby avoiding the failure of the connection between connectors which affects users' experience in the assembly process. Moreover the reinforcing rib 28 could also make it easier to insert the first connecting portion 10 into the containing slot 30, because of reduction of contact area between the connection plate 11 and the inner walls of the plate slot 31.

Referring to FIG. 1, FIG. 3, and FIG. 5, in this embodiment, a reinforcing rib 28 is disposed on each of two sides of the support plate 26 in the slot 261. One reinforcing rib 28 is disposed on each of the inner walls of the top board left part 251, the top board right part 252, the left side board 21, and the right side board 22, wherein the reinforcing ribs 28 on the top board left part 251 and the top board right part 252 are on the inner side of the deformation thin wall 271. It can be understood that the height of the two reinforcing ribs 28 on the support plate 26 can be designed to meet the height of the second connecting portion 20.

In order to guarantee the tightness of the connection between the first connecting portion 10 and the second connecting portion 20, the vertical distance between the reinforcing rib 28 on the support plate 26 and the reinforcing rib 28 on the top board 25 is equal to the thickness of the connection plate 11 of the first connector 10, and the vertical distance between the reinforcing rib 28 on the left side board 21 and the reinforcing rib 28 on the right side board 22 is equal to the length of a side of the square connection plate 11. Through the linear contact between the reinforcing rib 28 and the connection plate 11, the matching between the plate slot 31 and the connection plate 11 can be tightly, and the engagement therebetween is not easy to fail. Referring to FIG. 1 and FIG. 5, a bevel edge 281 is formed on an end of the reinforcing rib 28 far away from the back side board 23, that is, the bevel edge 281 is formed on the end of the reinforcing rib 28 close to the opening of the containing slot 30, which facilitates the first connecting portion 10 to be inserted into the containing slot 30. In addition, reverse round corners 255 are formed on a position of the top board left part 251 and the top board right part 252 close to the opening of the pillar slot 32, which facilitates the connection pillar 12 to be inserted into the pillar slot 32.

Referring to FIG. 2 and FIG. 3, a second chamfer 254 matching the first chamfer 121 is formed on an edge of the inner side wall of the top board left part 251, the top board back part 253, and the top board right part 252. The first chamfer 121 and the second chamfer 254 match with each other, thereby increasing the tightness of the matching between the first connecting portion 10 and the second connecting portion 20.

The limit grooves 40 and the limit protrudes 50 of the present disclosure compose engagement modules of a connector, that is, engagement modules are formed among a plurality of connectors of the toy assembling apparatus of the present disclosure. The engagement module comprises the limit groove 40 formed on the first connecting portion 10 or the second connecting portion 20 and the limit protrude 50 formed on the second connecting portion 20 or the first connecting portion 10. When assembling two connectors, the first connecting portion 10 of one connector is inserted into the containing slot 30 of the second connecting portion 20 of another connector, which has a simple assembly process while specific assembly tools are not needed. The limit grooves 40 match the limit protrudes 50, so as to implement a tight match between the first connecting portion 10 and the second connecting portion 20, thereby guaranteeing the tightness of the connection between two connectors and avoiding the failure of the connection between connectors in the process of assembling a toy.

It can be understood that, when assembling two connectors, two forces of opposite directions have to be imposed on the first connecting portion 10 of one connector and the second connecting portion 20 of another connector, until the limit groove 40 and the limit protrude 50 engage with each other. When disassembling two connectors, two forces of reverse directions have to be imposed on the first connecting portion 10 of one connector and the second connecting portion 20 of another connector, until the limit groove 40 and the limit protrude 50 disengage with each other, which has a simple assembly and disassembly process while specific assembly tools are not needed.

Figure 8:
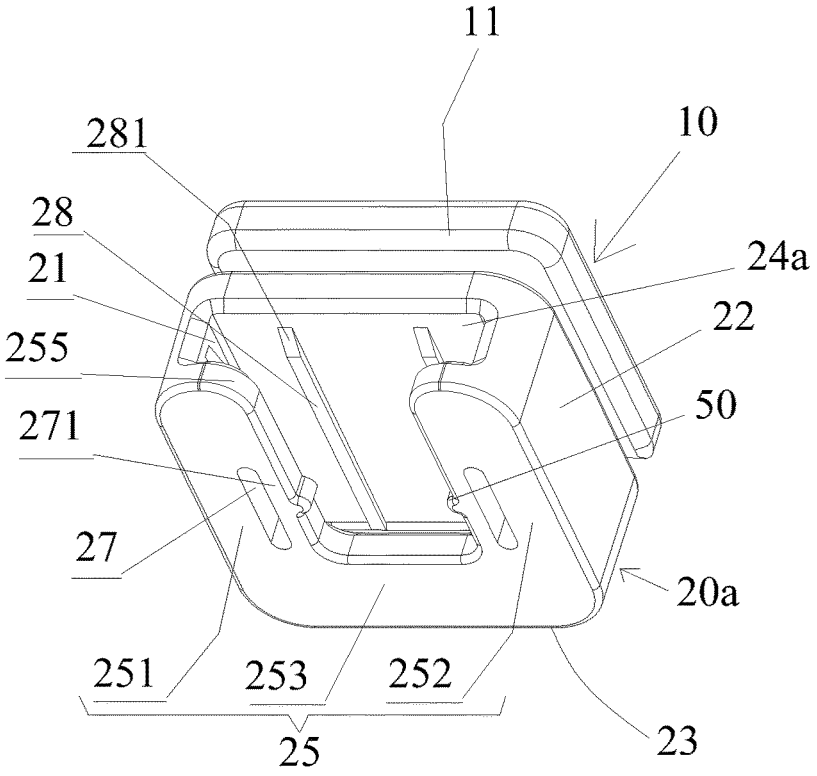
FIG. 8 is an isometric view of a connector of another embodiment according to the disclosure.

Referring to FIG. 8, an isometric view of a connector of another embodiment according to the disclosure is shown. It can be understood that the back side board 23 of a second connecting portion 20*a* can be without a circular connection aperture 231, and the support plate and the bottom board can be integrated into a bottom board 24*a* without the slot 261, while other structures are not changed and the same component numbers in the previous embodiment are used.

Figure 8A:
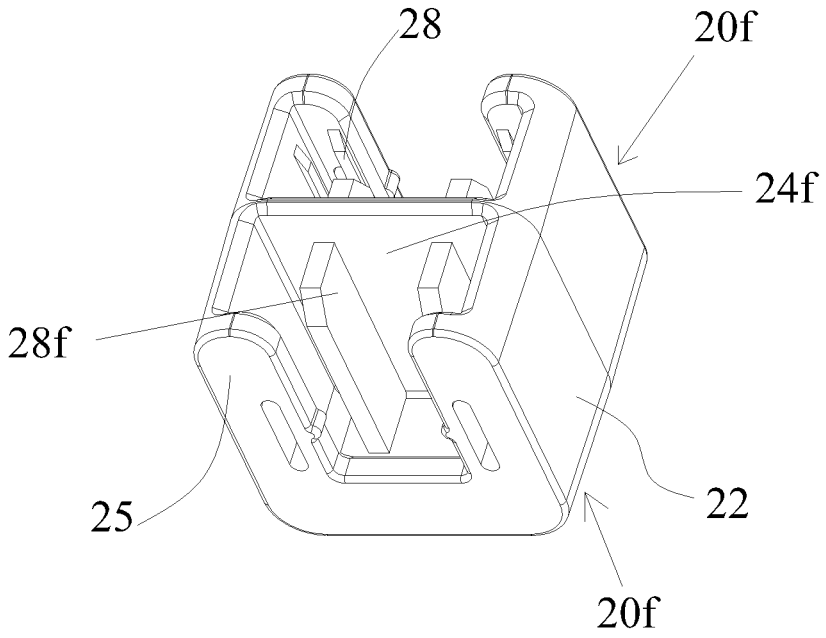
FIG. 8*a* is an isometric view of a connector of the still another embodiment according to the disclosure.

The distance between the bottom board 24*a* and the top board 25 can be increased to meet by needs, as long as the vertical distance between the reinforcing rib 28 on the bottom board 24*a* and the reinforcing rib 28 on the top board 25 is equal to the thickness of the connection plate 11 of the first connecting portion 10. Referring to FIG. 8*a*, an isometric view of a connector of the still another embodiment according to the disclosure is shown. The distance between the bottom board 24*f* and the top board 25 in a second connector 20*f* is greater than the distance between the second connecting portion 20*a* and the top board 25 in a second connecting portion 20*a* shown in FIG. 8. As a result, in order to remain the equality of the vertical distance between the reinforcing rib 28*f* on the bottom board 24*f* and the reinforcing rib 28 on the top board 25 and the thickness of the connection plate 11 of the first connecting portion 10, the height of the reinforcing rib 28*f* on the bottom board 24*f* shown in FIG. 8*a* have to be higher than the height of the reinforcing rib 28*a* on the bottom board 24*a* shown in FIG. 8, while the reinforcing ribs 28 on the inner wall of the top board 25, the left side board 21, and the right side board 22 are identical with the reinforcing ribs 28 shown in FIG. 8 or FIG. 1.

The connector shown in FIG. 8*a* comprises two over lapped second connecting portions 20*f* which share one bottom board 24*f* The toy assembly process can be finished by matching the first connecting portion 10 of another connector with one of the second connecting portions 20*f* of the connector.

Figure 8B:
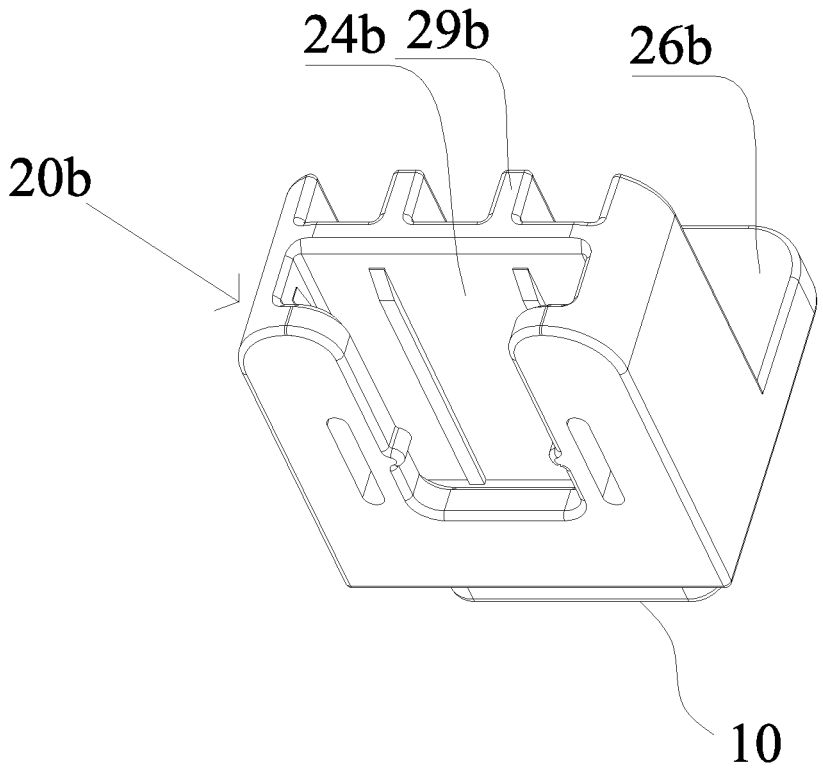
FIG. 8*b* is an isometric view of a connector of the other embodiment according to the disclosure.
Figure 8C:
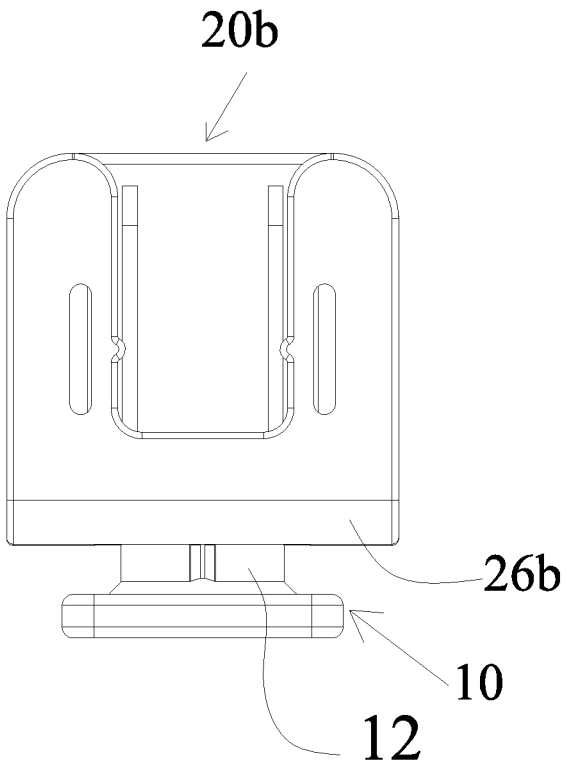
FIG. 8*c* is a bottom view of the connector shown in FIG. 8*b*.

The first connecting portion 10 shown in FIG. 8 and the second connecting portion 20*b* can also be connected through a connection board. Referring to FIG. 8*b* and FIG. 8*c*, a connector of the other embodiment according to the disclosure is shown. Particularly, a connection board 26*b* extends from the back side board 23 of the second connecting portion 20 band is perpendicular to the bottom board 24*b*, while the connection pillar 12 of the first connecting portion 10 is disposed on the connection board 26*b*. In this embodiment, the connection board 26*b* and a bottom board 24*b* are disposed in an L configuration, wherein the first connecting portion 10 and the second connecting portion 20*b* are on two sides of the connection board 26*b* respectively. Wherein, the connector can be used to match another connector, thereby forming a head component of an android toy building block robot. In order to meet the design needs relating to the height of the second connecting portion 20*b*, a plurality of reinforcing ribs 29*b* can be disposed on a back surface of the bottom board 24*b*, wherein the reinforcing ribs 29*b* extend in a direction parallel to the direction for inserting the first connecting portion 10 into the containing slot 30.

Figure 8D:
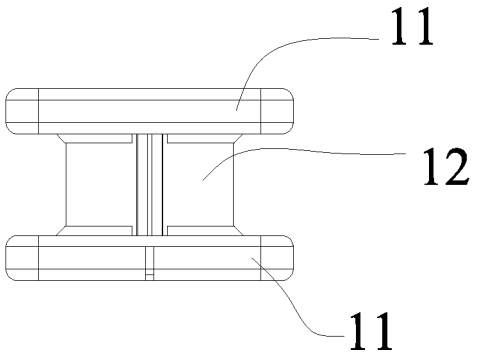
FIG. 8*d* is a front view of a connector of another embodiment according to the disclosure.

Referring to FIG. 8*d*, a front view of the connector of another embodiment according to the disclosure is shown. The differences among this embodiment and the embodiments shown in FIG. 1 and FIG. 8 are, in this embodiment, the connection plate 11 substitutes the second connecting portion, that is, the connector has two connection plates 11 which are located at two ends of the connector pillar 12. Since the characteristics of the connection plates 11 and the connector pillar 12 are identical to the above-mentioned connection plates 11 and connector pillar 12, the details are not recited herein.

Figure 9:
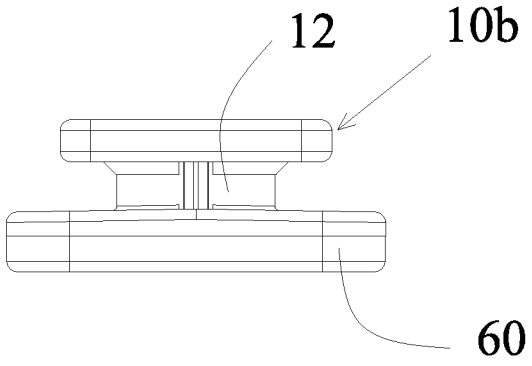
FIG. 9 is a front view of a connector of still another embodiment according to the disclosure.
Figure 10:
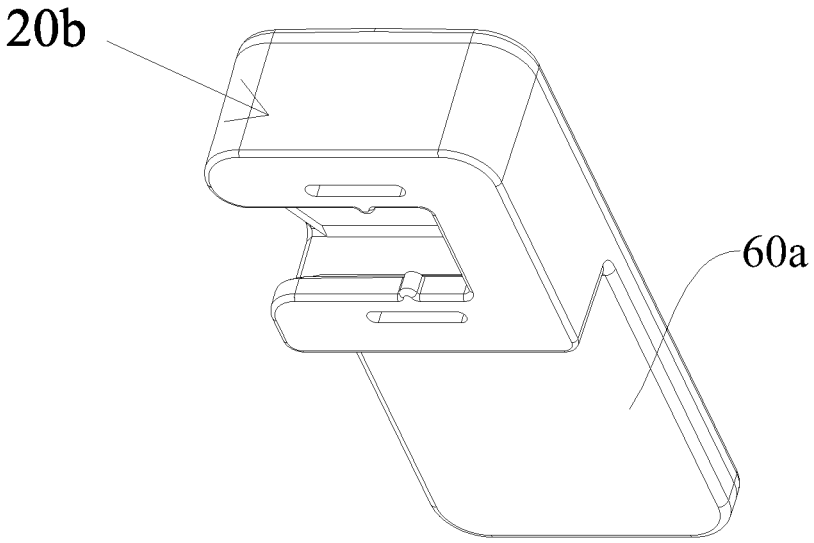
FIG. 10 is an isometric view of a connector of still another embodiment according to the disclosure.

Referring to FIG. 9 and FIG. 10, a connector of still another embodiment according to the disclosure is shown. FIG. 9 discloses a first connecting portion 10*b* disposed on a body 60, while FIG. 10 discloses a second connecting portion 20*b* disposed on a body 60*a*. Since the first connecting portion 10*b* has a same structure with the first connecting portion 10 shown in FIG. 1 to FIG. 8, the details are not recited herein. The structure of the second connecting portion 20*b* maybe identical to the structure of the second connecting portion 20 shown in FIG. 1 to FIG. 7, or to the second connecting portion 20*a* shown in FIG. 8, wherein the second connecting portion 20*b* shown in FIG. 10 has a same structure with the second connecting portion 20*a*. When assembling, the first connecting portion 10*b* shown in FIG. 9 is inserted into the second connecting portion 20*b* shown in FIG. 10.

Figure 11:
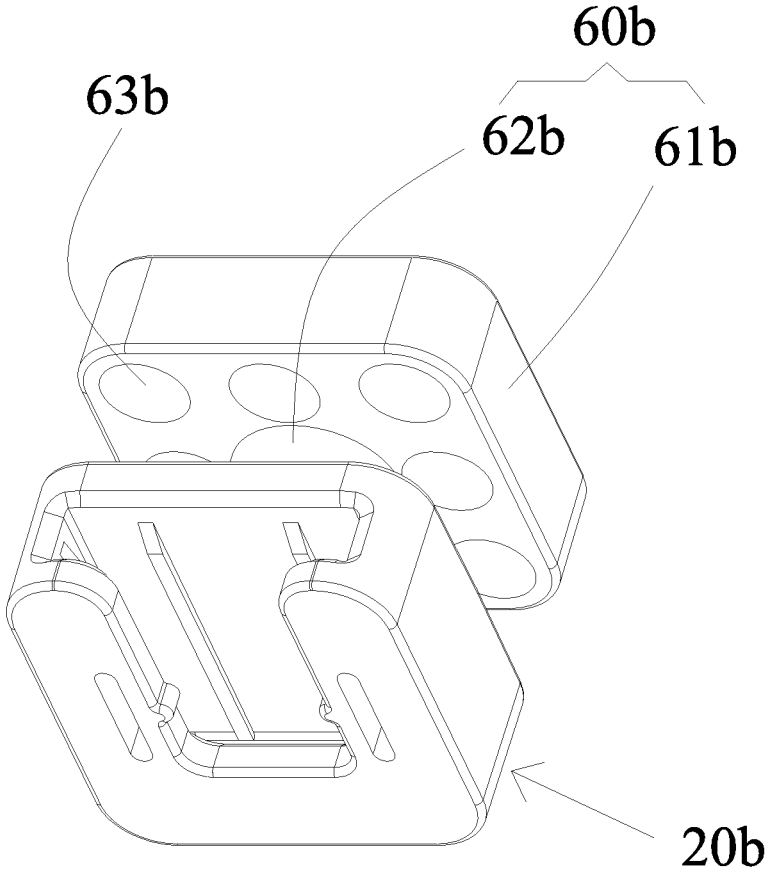
FIG. 11 is an isometric view of a connector of the other embodiment according to the disclosure.
Figure 12:
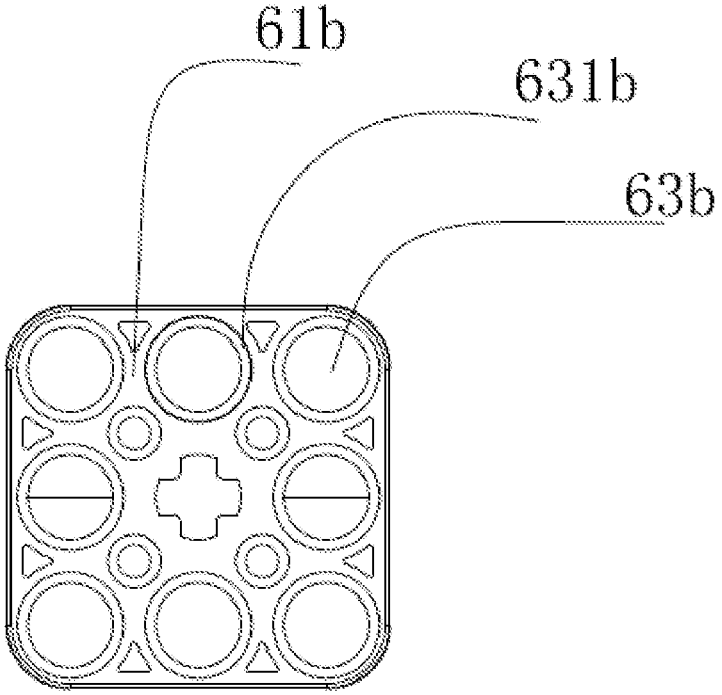
FIG. 12 is a top view of the connector shown in FIG. 11.

Alternatively, in this embodiment, the second connecting portion 20*b* can be disposed on another body. Referring to FIG. 11 and FIG. 12, a connector of the other embodiment according to the disclosure is shown. A body 60*b* comprises a connection plate 61*b* and a connection pillar 62*b* disposed on the connection plate 61*b*, wherein the connection plate 61*b* and the connection pillar 62*b* are integratedly molded. Wherein, N*M connection apertures 63*b* are disposed on the support board 61*b*, while N and M are integers greater than 2. In this embodiment, N and M each are equal to 3. Consequently, the support board 61*b* may be a square shape, and the connector composed by the body 60*b* and the second connecting portion 20*b* forms a cube, hence the inconvenience in assembling a plurality of connectors will not be caused by the differences in the lengths of different sides, and users' experience is therefore improved.

Furthermore, the connection aperture 63*b* may be a round shape or an X shape. The connection aperture 63*b* being a round shape or an X shape may be used to match another connector (e.g., connection bolt), thereby increasing users' experience. Particularly, limit emarginations 631*b* are formed on at least one end of the connection aperture 63*b*. The limit emarginations 631*b* are used to match the limit flange on a connection bolt. When the connection bolt is inserted to the connection aperture 63*b*, the limit flanges of the connection bolt engage the limit emarginations 631*b*, thereby avoiding the rough and uneven on the connection surface.

Figure 13:
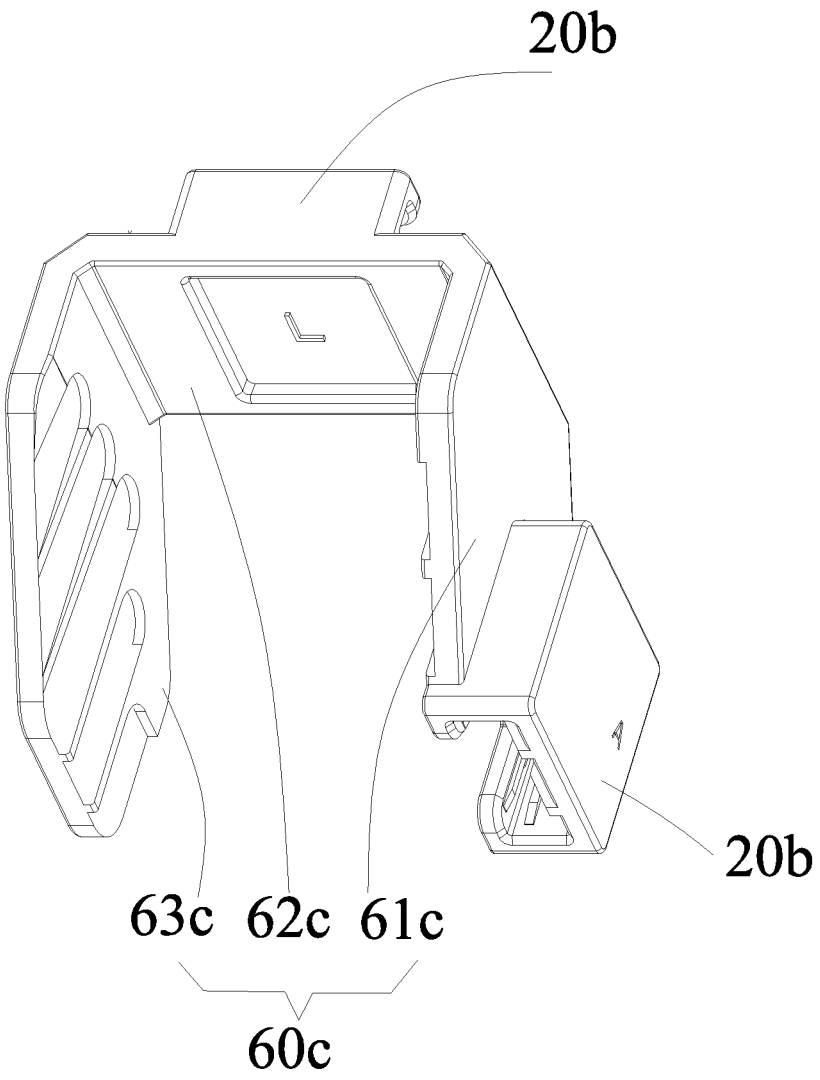
FIG. 13 is an isometric view of a connector of another embodiment according to the disclosure.
Figure 14:
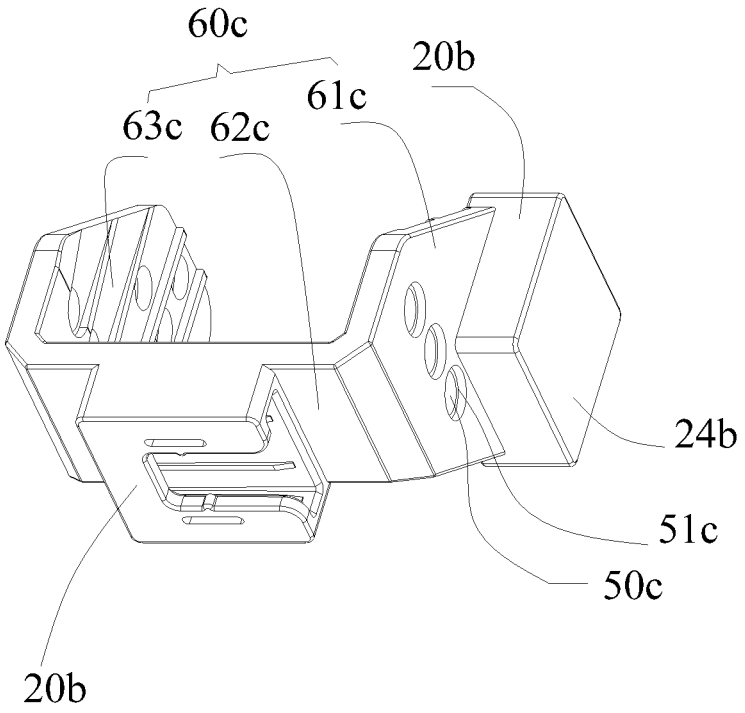
FIG. 14 is an isometric view of a connector of still another embodiment according to the disclosure.

Alternatively, in this embodiment, the second connecting portion 20*b* shown in FIG. 10 can be disposed on still another body. Referring to FIG. 13 and FIG. 14, a connector of still another embodiment according to the disclosure is shown. Two second connecting portions 20*b* are disposed on a body 60*c*. The body 60*c* comprises a first connection arm 61*c*, a second connection arm 62*c*, and a third connection arm 63*c*, wherein the first connection arm 61*c*, the second connection arm 62*c*, and the third connection arm 63*c* are integratedly molded, the first connection arm 61*c* and the third connection arm 63*c* are opposite and parallel with each other, and the second connection arm 62*c* is vertically connected to the first connection arm 61*c* and the third connection arm 63*c*. The first connection arm 61*c* and the third connection arm 63*c* have a hexagonal shape, wherein two opposite sides are parallel with each other, and a side connected with the second connection arm 62*c* is perpendicular to the second connection arm 62*c*. One of the second connecting portions 20*b* is disposed on the first connection arm 61*c*, another one of the second connecting portions 20*b* is disposed on the second connection arm 62*c*. It can be understood that the structure can be used to assemble a shoulder component of an android toy building block robot.

Furthermore, a plurality of circular connection apertures 50*c* are disposed on the first connection arm 61*c* and the third connection arm 63*c* shown in FIG. 14, which are used to connect the connector (e.g., connection bolt) of another connector, thereby increasing users' experience. Particularly, limit emarginations 51*c* are formed on at least one end of the connection aperture 50*c*. The limit emarginations 51*c* are used to match the limit flange on a connection bolt. When the connection bolt is inserted to the connection aperture 50*c*, the limit flanges of the connection bolt engage the limit emarginations 51*c*, thereby avoiding the rough and uneven on the connection surface.

Figure 15:
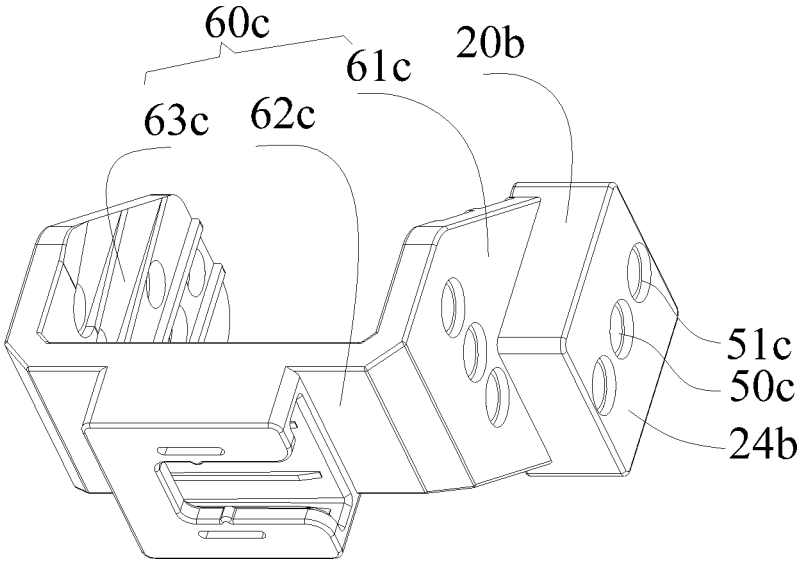
FIG. 15 is an isometric view of a connector of the other embodiment according to the disclosure.

Alternatively, connection apertures also can be formed on the bottom board 24*b* of the second connecting portion 20*b* on the second connection arm 62*c*. Referring to FIG. 15, an isometric view of a connector of the other embodiment according to the disclosure is shown. A plurality of the circular connection aperture 50*c* are formed in line on the bottom board 24*b* of the second connecting portion 20*b* on the first connection arm 61*c*, and the limit emarginations 51*c* are formed on the outer surface of the bottom board 24*b*. The distribution direction of the connection aperture 50*c* is identical to the direction for inserting the first connecting portion 10 into the containing slot 30.

Figure 15A:
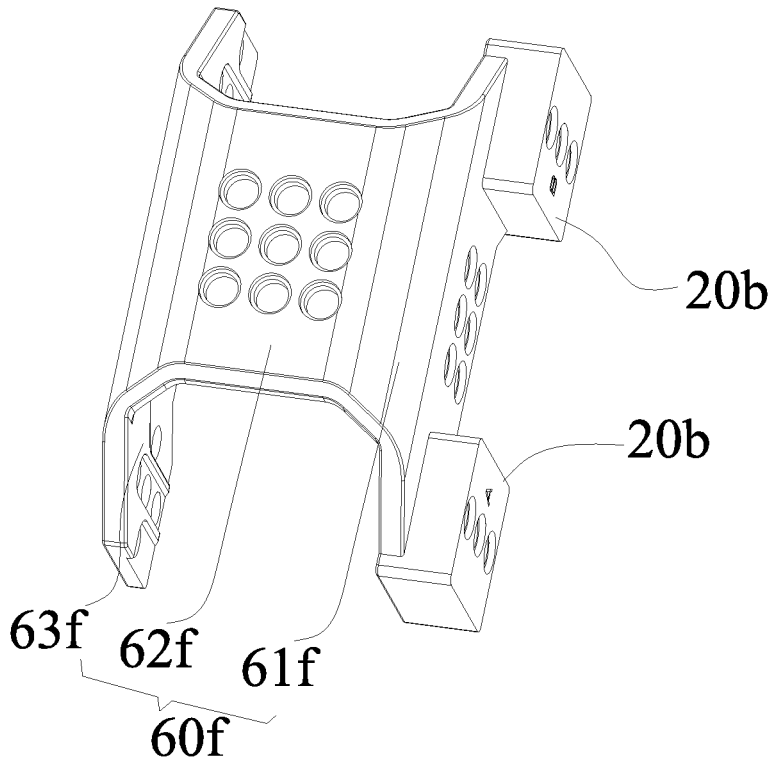
FIG. 15*a* is an isometric view of a connector of another embodiment according to the disclosure.
Figure 15B:
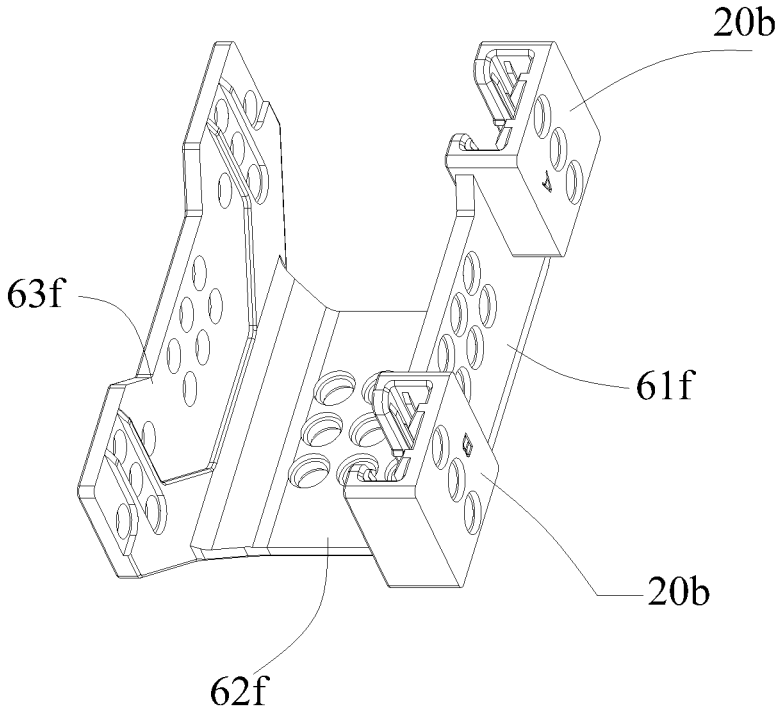
FIG. 15*b* is an isometric view of another angle of the connector shown in FIG. 15*a*.

Alternatively, the second connecting portion 20*b* can be disposed on two opposite ends of a same connection arm on a body. Referring to FIG. 15*a* and FIG. 15*b*, the connector of another embodiment according to the disclosure is shown. A body 60*f* comprises a first connection arm 61*f*, a second connection arm 62*f*, and a third connection arm 63*f*, wherein the first connection arm 61*f*, the second connection arm 62*f*, and the third connection arm 63*f* are integratedly molded, the first connection arm 61*f* and the third connection arm 63*f* are opposite and parallel with each other, and the second connection arm 62*f* is vertically connected to the first connection arm 61*f* and the third connection arm 63*f*. When assembling, the first connecting portion 10*b* shown in FIG. 9 could match the second connecting portion 20*b*. Wherein, the connection pillar 12 of the first connecting portion 10*b* could be alternatively configured as rotates with respect to the body 60, and the height of the body 60 matches the distance between the first connection arm 61*f* and the third connection arm 63*f*, so as to contain the connector inside the body 60*f*. As a result the second connecting portion 20*b* matches the first connecting portion 10*b*, such that the connector with the first connecting portion 10*b* rotates with respect to the connector with the second connecting portion 20*b* provided by this embodiment, thereby meeting design needs. It can be understood that the interior of the body 60*f* could match two connectors with the first connecting portion 10*b*, such that the two connectors could rotate arbitrarily and the three components can jointly form a knee joint component of an android toy building block robot.

Figure 16:
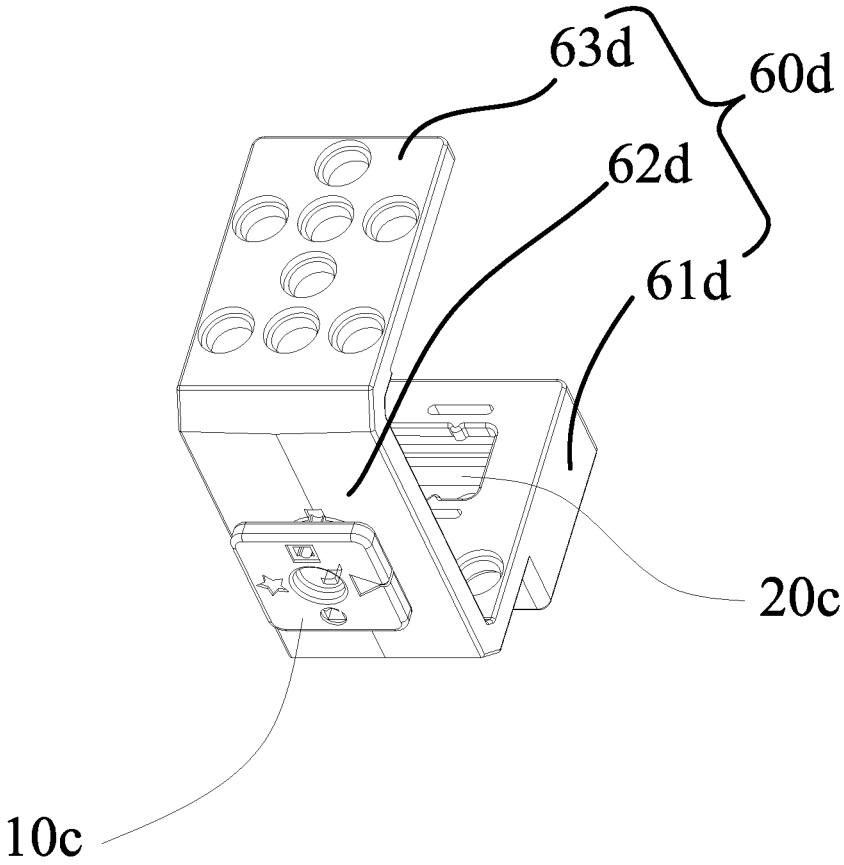
FIG. 16 is an isometric view of a connector of still another embodiment according to the disclosure.

Referring to FIG. 16, an isometric view of a connector of still another embodiment according to the disclosure is shown. The connector comprises a body 60*d*, a first connecting portion 10*c* and a second connecting portion 20*c*. Wherein the body 60*d* comprises a first connection arm 61*d*, a second connection arm 62*d*, and a third connection arm 63*d*, the first connection arm 61*d* and the third connection arm 63*d* are parallel with each other, the second connection arm 62*d* is vertically connected to the first connection arm 61*d* and the third connection arm 63*d*. The first connecting portion 10*c* and the second connecting portion 20*c* are disposed on two different surfaces of the body 60*d*, such as the first connecting portion 10*c* is disposed on the second connection arm 62*d*, while the second connecting portion 20*c* is disposed on the first connection arm 61*d*. When assembling, the first connecting portion 10*c* of one connector is engaged with the second connecting portion 20*c* of another connector. Wherein, the first connecting portion 10*c* may be same in the structure with the above-mentioned first connecting portion 10, and the second connecting portion 20*c* may be same in the structure with the second connecting portion 20*a*, the details are not recited herein. Surely, the second connecting portion 20*c* could also be the same in structure with the above-mentioned second connecting portion 20.

Figure 17:
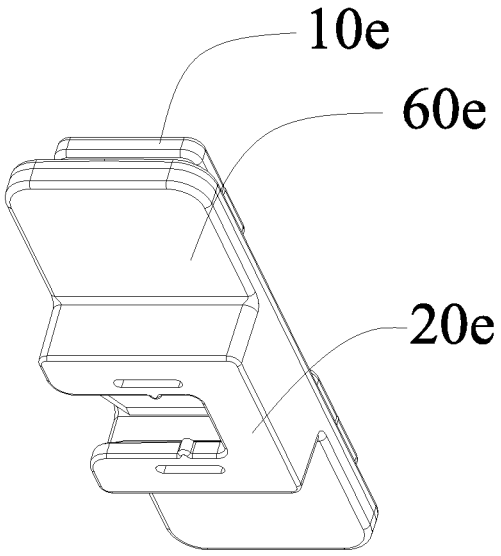
FIG. 17 is an isometric view of a connector of the other embodiment according to the disclosure.
Figure 18:
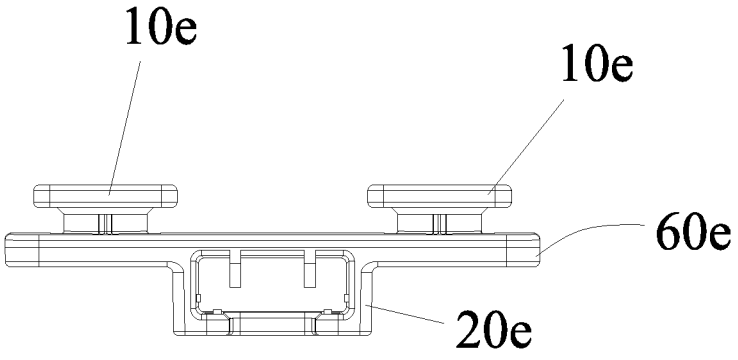
FIG. 18 is a front view of the connector shown in FIG. 17.

Referring to FIG. 17 and FIG. 18, a connector of the other embodiment according to the disclosure is shown. The connector comprises a rectangular body 60*e*, two first connecting portions 10*e* disposed on two end of the front of the body 60*e* respectively, and a second connecting portion 20*e* disposed between the two first connecting portions 10*e* and on the back of the body 60*e*. It can be understood that two second connecting portions 20*e* could be disposed on the front of the body 60*e*, and the first connecting portion 10*e* could be disposed one the back of the body 60*e*. Through matching the first connecting portion 10*e* of one connector with the second connecting portion 20*e* of another connector, a tight match between two connectors can be implemented, and the toy assembly process maybe successfully finished. The first connecting portion 10*e* may be same in structure with the above-mentioned first connecting portion 10. The second connecting portion 20*e* may be same in structure with the above-mentioned second connecting portion 20*a*, or be same in structure with the second connecting portion 20.

Figure 19:
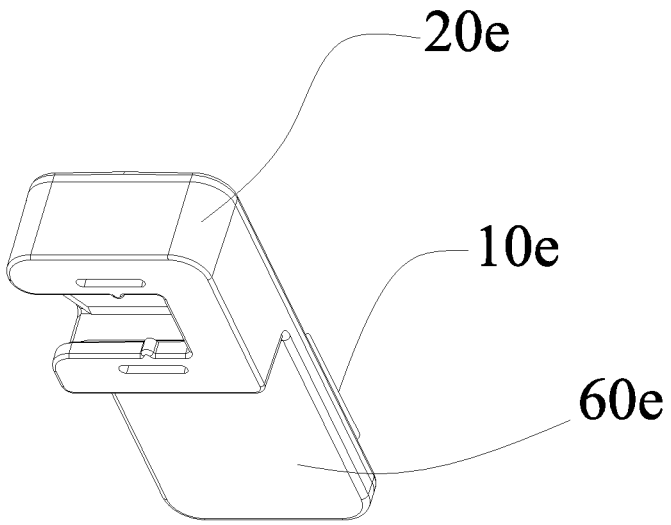
FIG. 19 is an isometric view of a connector of another embodiment according to the disclosure.
Figure 20:
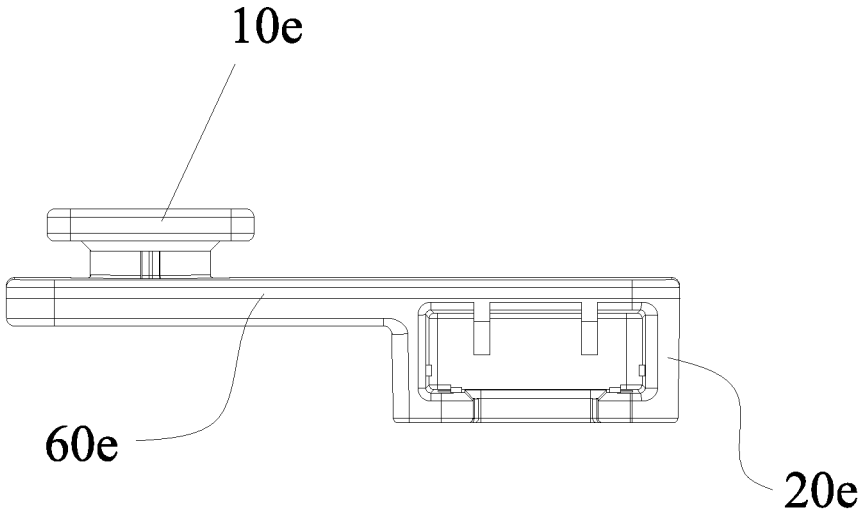
FIG. 20 is a front view of the connector shown in FIG. 19.

Referring to FIG. 19 and FIG. 20, a connector of another embodiment according to the disclosure is shown. It can be understood that the above-mentioned first connecting portion 10*e* may be disposed on merely one end of the body 60*e*, while the second connecting portion 20*e* may be disposed on the other end of the body 60*e* and on the opposite surface of the body 60*e* with respect to the first connecting portion 10*e*.

Figure 21:
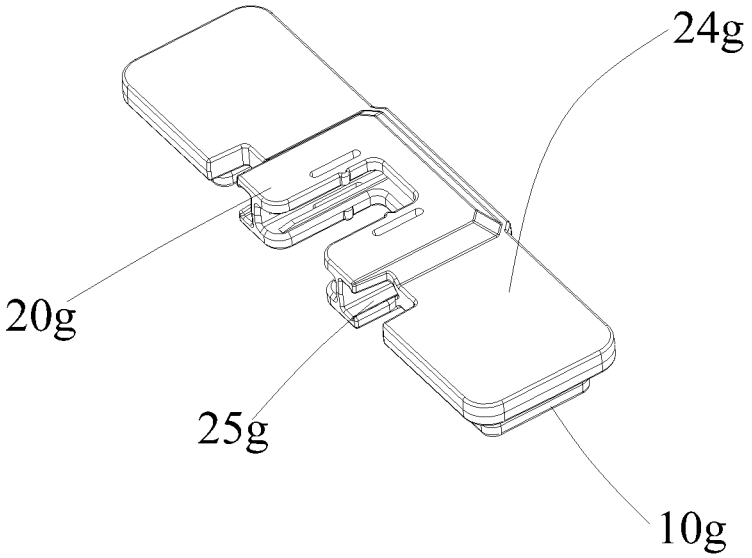
FIG. 21 is an isometric view of a connector of another embodiment according to the disclosure.
Figure 22:
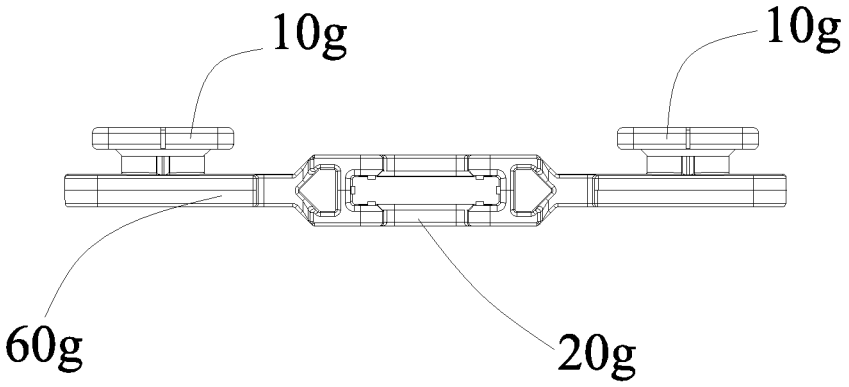
FIG. 22 is a front view of the connector shown in FIG. 21.

Referring to FIG. 21 and FIG. 22, a connector of another embodiment according to the disclosure is shown. The connector comprises two first connecting portions 10*g*, one second connecting portion 20*g*, and a body 60*g* connecting the first connecting portions 10*g* and the second connecting portion 20*g*. The first connecting portion 10*g* may be same in structure with the above-mentioned first connecting portion 10, while the difference between the second connecting portion 20*g* and the second connecting portion 20*a* shown in FIG. 8 is: the top board 25*g* and the bottom plate 24*g* are designed as symmetrical.

The shape of the above-mentioned body 60, 60*a*, 60*b*, 60*c*, 60*d*, 60*e*, and 60*f* comprises but not limited to square, rectangle, L-shape, and U-shape, which can be chosen according to design needs of a toy building block. For instance, use U-shaped body along with other connectors to compose a shoulder, an elbow, or other joint components of an android toy building block robot. In addition, the positions of the first connecting portions 10*b*, 10*c*, 10*e*, 10*g* and the second connecting portions 20*b*, 20*c*, 20*e*, 20*f*, and 20*g* on the body can be chosen according to design needs.

The structure of the first connecting portions 10, 10*a*, 10*b*, 10*c*, 10*e*, and 10*g* could be arbitrarily exchanged among the above-mentioned embodiments, and the structure of the second connecting portions 20, 20*a*, 20*b*, 20*c*, 20*e*, 20*f*, and 20*g* could also be arbitrarily exchanged among the above-mentioned embodiments. Any of the first connecting portions 10, 10*a*, 10*b*, 10*c*, 10*e*, 10*g* disclosed in the above-mentioned embodiments can be used along with any of the second connecting portions 20, 20*a*, 20*b*, 20*c*, 20*e*, 20*f*, and 20*g* disclosed in the above-mentioned embodiments.

The above description depicts merely some exemplary embodiments of the disclosure, but is meant to limit the scope of the disclosure. Any equivalent structure or flow transformations made to the disclosure, or any direct or indirect applications of the disclosure on other related fields, shall all be covered within the protection of the disclosure.

What is claimed is:

1. A toy assembling apparatus, comprising at least one connector, and each connector comprising at least one of a first connecting portion and a second connecting portion;

wherein the first connecting portion comprises a connection plate and a connection pillar disposed on the connection plate; and wherein the second connecting portion comprises a left side board, a right side board, a bottom board, and a top board, the left side board, the right side board, the bottom board, and the top board jointly form a containing slot for inserting the first connecting portion therein along a first direction, the containing slot comprises a plate slot for containing the connection plate and a pillar slot for containing the connection pillar; and wherein the connection pillar has one or more limit grooves or one or more limit protrudes formed thereon, the pillar slot has one or more protrudes or one or more limit grooves formed thereon correspondingly and extending in a second direction substantially perpendicular to the first direction;

wherein, when the first connecting portion of one connector is inserted into the second connecting portion of another connector, the connection plate of the connector is engaged in the plate slot of the another connector and the connection pillar of the connector is engaged in the pillar slot of the another connector so as to assemble these two connectors together, and the one or more limit grooves of one of these two connectors is engaged with the one or more limit protrudes of the other of these two connectors so as to limit their relative position along the first direction.

2. The toy assembling apparatus of claim 1, wherein the connection pillar is disposed on the bottom board such that the first connecting portion is integrated with the second connecting portion.

3. The toy assembling apparatus of claim 1, wherein the second connecting portion comprises a support plate disposed in the containing slot and a back side board, inner walls of the support plate, the left side board, the right side board, the back side board, and the top board jointly form the plate slot, and wherein at least one reinforcing rib is formed on each of inner walls of the support plate, the top board, the left side board, and the right side board, the reinforcing rib extends in the first direction.

4. The toy assembling apparatus of claim 3, wherein a circular connection aperture is formed on the back side board, a slot matching the circular connection aperture is formed on the support plate.

5. The toy assembling apparatus of claim 3, wherein a vertical distance between the reinforcing rib on the support plate and the reinforcing rib on the top board is equal to a thickness of the connection plate of the first connector.

6. The toy assembling apparatus of claim 1, wherein at least one reinforcing rib is formed on each of inner walls of the top board, the left side board, the right side board, and the bottom board, a vertical distance between the reinforcing rib on the bottom board and the reinforcing rib on the top board is equal to a thickness of the connection plate of the first connector.

7. The toy assembling apparatus of claim 6, wherein a bevel edge is formed on an end of the reinforcing rib far away from the back side board for facilitating insertion of the connection plate.

8. The toy assembling apparatus of claim 1, wherein the top board comprises a top board left part, a top board back part, and a top board right part, inner side walls of the top board left part, the top board back part, and the top board right part jointly form the pillar slot, a set of the limit protrudes or the limit grooves are formed on opposite positions on the inner side walls of the top board left part and the top board right part respectively, at least one set of the limit grooves or the limit protrudes are formed on opposite sides of the connection pillar.

9. The toy assembling apparatus of claim 8, wherein a bar slot is formed in each of the top board left part and the top board right part respectively, the bar slot is parallel to the first direction and aligns with the limit protrude or the limit groove to provide deformation space.

10. The toy assembling apparatus of claim 1, wherein the connection plate has a square shape, four limit protrudes or limit grooves are uniformly distributed on the connection pillar, each of the limit groove or the limit protrude is disposed aligning with a center of each side of the connection plate.

11. The toy assembling apparatus of claim 1, wherein the toy assembling apparatus comprises a plurality of connectors, and the first connecting portion and the second connecting portion are disposed on different connectors respectively.

12. The toy assembling apparatus of claim 11, wherein one of the connectors is composed of two second connecting portions, and the two second connecting portions are disposed symmetrically and share one same bottom board.

13. The toy assembling apparatus of claim 11, wherein one of the connectors comprises a first body, and the first connecting portion is disposed on the first body; and wherein another of the connectors comprises a second body, and the second connecting portion is disposed on the second body.

14. The toy assembling apparatus of claim 13, wherein the second body comprises a first connection arm, a second connection arm, and a third connection arm, the first connection arm and the third connection arm are parallel with each other, the second connection arm is vertically connected to the first connection arm and the third connection arm;

wherein one second connecting portion is disposed on the first connection arm, and another second connecting portion is disposed on the second connection arm.

15. The toy assembling apparatus of claim 13, wherein the second body comprises a first connection arm, a second connection arm, and a third connection arm, the first connection arm and the third connection arm are parallel with each other, the second connection arm is vertically connected to the first connection arm and the third connection arm; and wherein the first connection arm has two opposite ends, two second connecting portions are disposed on the two opposite ends respectively.

16. The toy assembling apparatus of claim 13, wherein the second body is the connection plate, and the connection pillar connects the connection plate to the second connecting portion, N*M connection apertures are disposed on the support board, and N and M are integers greater than 2.

17. The toy assembling apparatus of claim 1, wherein one of the connectors comprises a body, the first connecting portion and the second connecting portion are disposed on the body.

18. The toy assembling apparatus of claim 17, wherein the body comprises a first connection arm, a second connection arm, and a third connection arm, the first connection arm and the third connection arm are parallel with each other, the second connection arm is vertically connected to the first connection arm and the third connection arm, the first connecting portion is disposed on the second connection arm, the second connecting portion is disposed on the first connection arm.

19. The toy assembling apparatus of claim 17, wherein the body has two opposite sides, the first connecting portion is disposed on one of the sides of the body, the second connecting portion is disposed on the other one of the sides of the body.

20. The toy assembling apparatus of claim 19, wherein two first connecting portions are disposed on the body, the two first connecting portions are respectively on two ends of one surface of the body, and the second connecting portion is disposed between the two first connecting portions.

21. The toy assembling apparatus of claim 1, wherein a connection board extends from the back side board and is perpendicular to the bottom board, the first connecting portion and the second connecting portion are on two sides of the connection board respectively, a plurality of reinforcing ribs are disposed on a back surface of the bottom board.

22. The toy assembling apparatus of claim 1, wherein the first connecting portion further comprises a second connection plate disposed on the connection pillar, the connection plate and the second connection plate have a same structure, and are respectively disposed on two opposite ends of the connection pillar.

23. A toy assembling apparatus, comprising:

a building block connector, wherein the connector comprises a connection plate and a connection pillar disposed on the connection plate, one or more limit grooves are defined in the connection pillar, and the limit groove extends in a direction parallel to an axial direction of the connection pillar;

wherein, the building block connector is configured to be connected to another connector, the another connector comprises a containing slot extending in a first direction, one or more limit protrudes are formed in the containing slot and extend in a second direction substantially perpendicular to the first direction;

wherein, when the building block connector is connected to the another connector, the connection plate and the connection pillar are inserted into the containing slot of the another connector along the first direction, and the one or more limit grooves of the connection pillar match the one or more limit protrudes of the containing slot of the another connector so as to limit a relative position of the building block connector and the another connector along the first direction.

24. A toy assembling apparatus, comprising:

a building block connector formed in a hexahedron shape, wherein the connector comprises a left side board, a right side board, a back side board, a bottom board, and a top board, an opening is formed above the bottom board and opposite to the back side board, a plate slot communicating the opening and extending in a first direction is formed between the bottom board and the top board, a pillar slot communicating the plate slot and extending in the first direction is formed in the top board, the pillar slot is confined by three inner sides of the top board, limit protrudes are formed on two opposite inner sides of the top board and extend in a second direction substantially perpendicular to the first direction;

wherein, the building block connector is configured to be connected to another connector, the another connector comprises a connection plate and a connection pillar disposed on the connection plate, the connection pillar defines one or more limit grooves;

wherein, when the building block connector is connected to the another connector, the connection plate and the connection pillar of the another connector are inserted into the containing slot of the building block along the first direction, and the one or more limit protrudes of the pillar slot match the one or more limit protrudes of the connection pillar of the another connector so as to limit a relative position of the building block connector and the another connector along the first direction.

25. The toy assembling apparatus of claim 24, wherein two reinforcing ribs are disposed on a surface of top board facing the plate slot, the two reinforcing ribs are distributed symmetrically at two sides of the pillar slot, and a pair of reinforcing ribs are disposed on the bottom board.

* * * * *